US011938984B2

(12) United States Patent
Liu et al.

(10) Patent No.: US 11,938,984 B2
(45) Date of Patent: Mar. 26, 2024

(54) MULTI-LAYER COUPLING RELATIONSHIP-BASED TRAIN OPERATION DEVIATION PROPAGATION CONDITION RECOGNITION METHOD

(71) Applicant: CASCO SIGNAL LTD., Shanghai (CN)

(72) Inventors: Fengbo Liu, Shanghai (CN); Jing Xu, Shanghai (CN); Honghui Yan, Shanghai (CN); Jiang Qian, Shanghai (CN); Tingliang Zhou, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 224 days.

(21) Appl. No.: 17/596,085

(22) PCT Filed: Oct. 19, 2020

(86) PCT No.: PCT/CN2020/121864
§ 371 (c)(1),
(2) Date: Dec. 2, 2021

(87) PCT Pub. No.: WO2021/098430
PCT Pub. Date: May 27, 2021

(65) Prior Publication Data

US 2022/0315075 A1 Oct. 6, 2022

(30) Foreign Application Priority Data

Nov. 23, 2019 (CN) ..... 201911160257.2

(51) Int. Cl.
*B61L 27/14* (2022.01)
*B61L 27/40* (2022.01)

(52) U.S. Cl.
CPC ..... *B61L 27/14* (2022.01); *B61L 27/40* (2022.01)

(58) Field of Classification Search
CPC ..... B61L 27/14; B61L 27/40; B61L 27/10; B61L 27/16; B61L 27/50
See application file for complete search history.

(56) References Cited

FOREIGN PATENT DOCUMENTS

CN 103723168 A 4/2014
CN 108945004 A 12/2018
(Continued)

OTHER PUBLICATIONS

Zhan et al., "Real-time train rescheduling on high-speed railway under partial segment blockages", Journal of the China Railway Society, vol. 38, No. 10, Oct. 2016, with English Abstract, 13 pages provided.

(Continued)

*Primary Examiner* — Russell Frejd
(74) *Attorney, Agent, or Firm* — HAMRE, SCHUMANN, MUELLER & LARSON, P.C.

(57) ABSTRACT

The present invention relates to a multi-layer coupling relationship-based train operation deviation propagation condition recognition method, where the method includes the following steps: (1) recognizing an effective train event time sequence, including an arrival event and a departure event of a train at each passing station; (2) uniformly extracting train activity data, including a stop activity, a section operation activity, a turn-back activity, and an arrival or departure interval activity; (3) constructing coupling relationship groups between a train event and a train activity and between train activities; and (4) performing statistics on changes of train operation deviation in each relationship group, and outputting a respective distribution function and a time-space distribution visualized result. Compared with the prior art, the present invention has the advantages of being practical, automatic recognition, feedback optimization, and the like.

8 Claims, 1 Drawing Sheet

(56) References Cited

FOREIGN PATENT DOCUMENTS

| | | | |
|---|---|---|---|
| CN | 109740839 | A | 5/2019 |
| CN | 111016976 | A | 4/2020 |
| JP | 2015003625 | A | 1/2015 |

OTHER PUBLICATIONS

Internal Search Report and Written Opinion issued in PCT/CN2020/121864, dated Jan. 19, 2021.

MULTI-LAYER COUPLING RELATIONSHIP-BASED TRAIN OPERATION DEVIATION PROPAGATION CONDITION RECOGNITION METHOD

FIELD OF TECHNOLOGY

The present invention relates to the field of rail transit train operation data processing, and in particular, to a multi-layer coupling relationship-based train operation deviation propagation condition recognition method.

BACKGROUND

An urban rail transit automatic train supervision (ATS) system can record an arrival time or a departure time of each train at each station track and attributes such as deviation from a plan, a destination, and a direction. This type of train operation data is a result of co-action of preliminary planning and on-site requirement, reflecting various states of a driving process, and the performance characteristics of the data are of great significance for test and optimization of a plan.

In recent years, with the improvement of a scale of a rail transit road network and the progress of related hardware device facilities and a computer technology, an operation management work is continuously refined and developed, so that collection and storage of the train operation data are gradually normalized. However, in most rail transit departments in China, the train operation data is mainly used for calculating performance indicators such as a fulfilled rate and punctuality and delay, the mining analysis of the train operation data has not yet received much attention, and the data is not sufficiently utilized. In the research field, the domestic research on actual train operation data is still in an early station, and a systematic data analysis method has not been formed.

Chinese Patent Publication No. CN108945004A discloses an invention patent entitled "METHOD AND SYSTEM FOR ANALYZING TRAIN OPERATION DEVIATION CONDITION", in the invention patent, after complete and effective train operation data is selected, and an operation deviation time is divided and labeled by using a chromaticity diagram, so that an initial delay position is traced. However, this solution is aimed at the delay of a single train and visualization of the train, and does not consider a complex situation of a multi-layer coupling relationship, resulting in relatively large limitation.

SUMMARY

An objective of the present invention is to provide a multi-layer coupling relationship-based train operation deviation propagation condition recognition method, which has the advantages of being practical, automatic recognition, and feedback optimization.

The purpose of the present invention may be achieved through the following technical solutions.

A multi-layer coupling relationship-based train operation deviation propagation condition recognition method is provided, including the following steps:

(1) recognizing an effective train event time sequence, including an arrival event and a departure event of a train at each passing station;

(2) uniformly extracting train activity data, including a stop activity, a section operation activity, a turn-back activity, and an arrival or departure interval activity;

(3) constructing coupling relationship groups between a train event and a train activity and between train activities; and (4) performing statistics on changes of train operation deviation in each relationship group, and outputting a respective distribution function and a time-space distribution visualized result.

Preferably, the effective train event time sequence is specifically an effective event time sequence obtained by removing an abnormal value caused by a system error according to train operation data provided by an urban rail transit automatic train supervision system ATS, deleting data for an abnormal stop, thus obtaining effective event data, and sorting the effective event data according to type requirements of train activities to be extracted.

Preferably, the type requirements of the train activities are specifically as follows:

to extract the train stop activity, the section operation activity, and the turn-back activity, the effective event data needs to be sorted in ascending order according to a date, a train number, and a time of occurrence, thus obtaining a time sequence 1 of an arrival event and a departure event of a train at each station; and to extract the arrival or departure interval activity, the effective event data needs to be sorted in ascending order according to a date, a station, a direction, and a time of occurrence, thus obtaining a time sequence 2 of an arrival event and a departure event of a train at each station.

Preferably, each train activity is formed by two associated train events and is specifically as follows:

according to the time sequence 1 of the arrival event and the departure event of the train at each station, adjacent arrival-departure events in the same direction form the stop activity, adjacent departure-arrival events or departure-departure events in the same direction form the section operation activity, and adjacent departure-arrival events or arrival-departure events in an opposite direction form the turn-back activity; and according to the time sequence 2 of the arrival event and the departure event of the train at each station, adjacent arrival-arrival events in the same direction form the arrival interval activity, and adjacent departure-departure events in the same direction form the departure interval activity.

Preferably, the coupling relationship group between the train event and the train activity specifically includes:

a relationship group between the arrival event and an activity associated with the arrival event, including a relationship between an arrival event of a train at a station and a stop activity of the train, and a relationship between the arrival event and an arrival interval activity of a subsequent train; and a relationship group between the departure event and an activity associated with the departure event, including a relationship between a departure event of a train at a station and a subsequent section operation activity of the train and a relationship between the departure event and a departure interval activity of a previous train at a subsequent station.

Preferably, the coupling relationship group between the train activities specifically includes:

a relationship group between adjacent activities of the same train, including: a relationship between a stop activity of the same train at a station and an operation activity of the train between two sections before and after the train, a relationship between an operation activity of the train in one section and a stop activity of the train at two stations before and after the train, and a relationship among an end-to-stop activity when turning back after arriving a station, a rail transferring activity, and a departure stop activity; and a relationship group between adjacent activities of adjacent trains, including: a relationship between a stop activity of a train at a station and a departure interval activity between two trains before and after the train and the train, and a relationship between an operation activity of a train in a section and an arrival interval activity between two trains before and after the train and the train at a subsequent station.

Preferably, the changes of train operation deviation in each relationship group specifically include:

for the relationship between the activity and the event, statistically fitting a distribution function of activity time deviation changing with the event time deviation; and for the relationship between the activities, counting a degree of change for time deviation of each group of associated activities in each time period and each line section.

Preferably, the time periods include: an early flat peak, an early high peak, a noon flat peak, a late high peak, a late flat peak, and a night flat peak.

Compared with the prior art, the present invention has the following advantages:

1. In the present invention, an effective train event time sequence is uniformly recognized and screened according to a current urban rail transit train operation collection state, which fits to actual operation management.
2. In the present invention, various train activity data is extracted respectively based on a train event time sequence sorted according to a train number or according to a station respectively, and a method for automatically recognizing train activity data is established.
3. In the present invention, coupling relationship groups between a plurality of train events and a plurality of train activities are constructed, to reflect an actual multi-train operation process and relationship.
4. In the present invention, a propagation rule of the train operation deviation in a space-time range is mastered by fitting a distribution change function of train operation deviation within each relationship group, and the result can be used for parameter verification, quality evaluation, and feedback optimization of real-time operation adjustment of a plan operation diagram.

DESCRIPTION OF THE EMBODIMENTS

Clear and complete description will be made to the technical solutions in embodiments of the present invention in conjunction with drawings in the embodiments of the present invention hereafter. Obviously, the described embodiments are merely a part of embodiments of the present invention and not all the embodiments. Based on the embodiments of the present invention, all of other embodiments obtained by a person of ordinary skill in the art without any creative effort shall belong to the protection scope of the present invention.

According to the method in the present invention, an effective train event time sequence is uniformly recognized and screened according to a current urban rail transit train operation collection state. Various train activity data is extracted respectively based on a train event time sequence sorted according to a train number or according to a station respectively. Considering a coupling relationship group between a plurality of events and a plurality of activities, statistics is performed on changes of train operation deviation in each relationship group, and a respective distribution function and a time-space distribution visualized result are outputted, thus obtaining a propagation condition of the train operation deviation in the space-time range.

Figure 1:
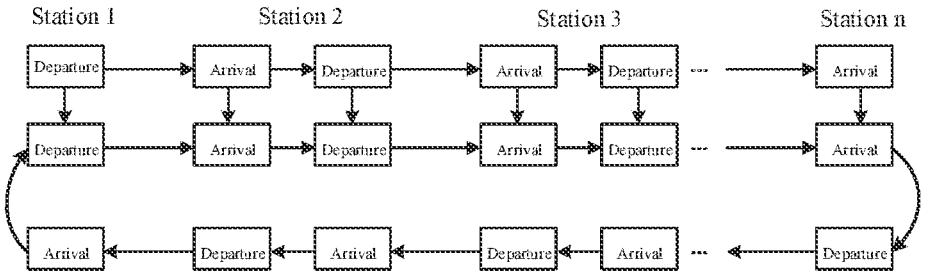
FIG. 1 is a schematic diagram of an activity-event coupling relationship of the present invention.
Figure 2:
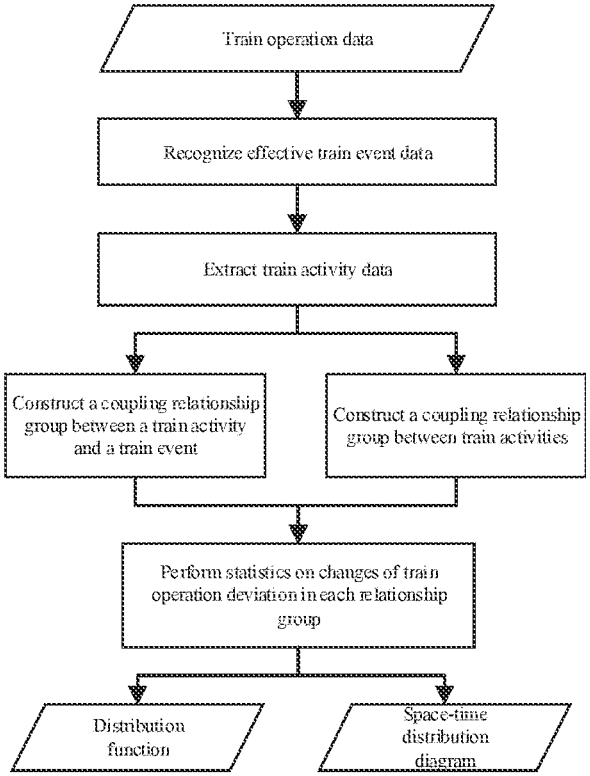
FIG. 2 is a flowchart of the present invention.

The present invention is further described below, and the method of the present invention includes the following steps (FIG. 2):

1. Recognize effective train event data. Step 1 mainly includes screening data of an arrival data and a departure event of a train at a normal stop, and sorting the data according to a specified condition, thus obtaining an event time sequence. An existing commonly used data format is shown in Table 1:

TABLE 1

| | | | | | | |
|---|---|---|---|---|---|---|
| TRAIN_ ID | DESTINATION_ CODE | GROUP_ TRAIN_ ID | LOCAL_ SUB_ID | GLOBAL_ SUB_ID | TRAIN_ ATTRIBUTE | STATION |
| PLAT-FORM | ARRIVAL_ DEPARTURE_ FLAG | DATE_ VALUE | TIME_ VALUE | DATE _ VALUE_ EXPECTED | TIME_ VALUE_ EXPECTED | TIME_ DIFF_ FROM_ SCHD |

2. Extract train activity data. Various train activities are calculated and distinguished according to the train event sequence, and the train activities mainly include a train section operation activity, a train stop activity, a train turn-back activity, and a train operation interval activity. Each activity is formed by two associated events, which are an arrival event and a departure event. Herein, in the present invention, data field in Table 1 represents arrival event information and departure event information of a train activity and a data field of a formed activity that is defined in Table 2. Table 1 and Table 2 form the train activity data format together.

TABLE 2

| | | | | |
|---|---|---|---|---|
| TO_STATION | TO_PLATFORM | TO_TIME_VALUE | TO_VALUE_ EXPECTED | TO_DIFF_ FROM_SCHD |
| DURA_TYPE | DURA_DIRECTION | DURA_VALUE | DURA_VALUE_ EXPECTED | DURA_DIFF_ FROM_SCHD |

3. Construct coupling relationship groups between a train activity and a train event and between train activities. A relationship group between a train activity and a train event includes a relationship group between an arrival event and associated activities before and after the arrival event, and a relationship group between a departure event and associated activities before and after the departure event. A relationship group between train activities includes a relationship group between a stop activity and associated activities before and after the stop activity, a relationship group between a section operation activity and associated activities before and after the section operation activity, and a relationship between a rail transferring activity and two stop activities before and after the rail transferring activity. The associated activities include adjacent activities of the same train and adjacent activities of adjacent trains.
4. Perform statistics on changes of train operation deviation in each relationship group. It mainly includes a distribution function of activity time deviation changing with event time deviation, and a combined change of time deviation of each group of associated activities in different time-space ranges.

The event data includes event time deviation data (Table 1), and the extracted activity data includes activity time deviation data (Table 2). Associated deviation data is retrieved based on the coupling relationships in step 3 and statistical analysis is performed, so that the distribution function of the activity time deviation changing with the event time deviation within a custom range and a time-space distribution virtualized result of associated activity time deviation can be displayed.

The above descriptions are only specific implementations of the present invention. However, the protection scope of the present invention is not limited thereto, any person skilled in the art can easily think of various equivalent modifications or substitutions within the technical scope disclosed by the present invention, and all of these modifications or substitutions shall fall within the protection scope of the present invention. Therefore, the protection scope of the present invention should be determined with reference to the appended claims.

What is claimed is:

1. A multi-layer coupling relationship-based train operation deviation propagation condition recognition and adjustment method, comprising the following steps:

recognizing an effective train event time sequence, comprising an arrival event and a departure event of a train at each passing station;

uniformly extracting train activity data, comprising a stop activity, a section operation activity, a turn-back activity, and an arrival or departure interval activity;

constructing coupling relationship groups between a train event and a train activity and between train activities;

performing statistics on changes of train operation deviation in each relationship group to determine a respective distribution function and a time-space distribution visualized result;

determining a propagation condition of the train operation deviation in a space-time range for the multiple trains based on the respective distribution function and the time-space distribution visualized result; and performing a feedback optimization to adjust real-time train operation for the multiple trains based on the propagation condition of the train operation deviation.

2. The multi-layer coupling relationship-based train operation deviation propagation condition recognition and adjustment method according to claim 1, wherein the effective train event time sequence is specifically an effective event time sequence obtained by removing an abnormal value caused by a system error according to train operation data provided by an urban rail transit automatic train supervision system ATS, deleting data for an abnormal stop, thus obtaining effective event data, and sorting the effective event data according to type requirements of train activities to be extracted.

3. The multi-layer coupling relationship-based train operation deviation propagation condition recognition and adjustment method according to claim 2, wherein the type requirements of the train activities are specifically as follows:

to extract the train stop activity, the section operation activity, and the turn-back activity, the effective event data needs to be sorted in ascending order according to a date, a train number, and a time of occurrence, thus obtaining a time sequence 1 of an arrival event and a departure event of a train at each station; and to extract the arrival or departure interval activity, the effective event data needs to be sorted in ascending order according to a date, a station, a direction, and a time of occurrence, thus obtaining a time sequence 2 of an arrival event and a departure event of a train at each station.

4. The multi-layer coupling relationship-based train operation deviation propagation condition recognition and adjustment method according to claim 3, wherein each train activity is formed by two associated train events and is specifically as follows:

according to the time sequence 1 of the arrival event and the departure event of the train at each station, adjacent arrival-departure events in the same direction form the stop activity, adjacent departure-arrival events or departure-departure events in the same direction form the section operation activity, and adjacent departure-arrival events or arrival-departure events in an opposite direction form the turn-back activity; and according to the time sequence 2 of the arrival event and the departure event of the train at each station, adjacent arrival-arrival events in the same direction form the arrival interval activity, and adjacent departure-departure events in the same direction form the departure interval activity.

5. The multi-layer coupling relationship-based train operation deviation propagation condition recognition and adjustment method according to claim 4, wherein the coupling relationship group between the train event and the train activity specifically comprises:

a relationship group between the arrival event and an activity associated with the arrival event, including a relationship between an arrival event of a train at a station and a stop activity of the train, and a relationship between the arrival event and an arrival interval activity of a subsequent train; and a relationship group between the departure event and an activity associated with the departure event, including a relationship between a departure event of a train at a station and a subsequent section operation activity of the train and a relationship between the departure event and a departure interval activity of a previous train at a subsequent station.

6. The multi-layer coupling relationship-based train operation deviation propagation condition recognition and adjustment method according to claim 4, wherein the coupling relationship group between the train activities specifically comprises:

a relationship group between adjacent activities of the same train, comprising: a relationship between a stop activity of the same train at a station and an operation activity of the train between two sections before and after the train, a relationship between an operation activity of the train in one section and a stop activity of the train at two stations before and after the train, and a relationship among an end-to-stop activity when turning back after arriving a station, a rail transferring activity, and a departure stop activity; and a relationship group between adjacent activities of adjacent trains, including: a relationship between a stop activity of a train at a station and a departure interval activity between two trains before and after the train and the train, and a relationship between an operation activity of a train in a section and an arrival interval activity between two trains before and after the train and the train at a subsequent station.

7. The multi-layer coupling relationship-based train operation deviation propagation condition recognition and adjustment method according to claim 1, wherein the changes of train operation deviation in each relationship group specifically comprise:

for the relationship between the activity and the event, statistically fitting a distribution function of activity time deviation changing with the event time deviation; and for the relationship between the activities, counting a degree of change for time deviation of each group of associated activities in each time period and each line section.

8. The multi-layer coupling relationship-based train operation deviation propagation condition recognition and adjustment method according to claim 7, wherein the time periods comprise: an early flat peak, an early high peak, a noon flat peak, a late high peak, a late flat peak, and a night flat peak.

* * * * *